US007000503B2

(12) United States Patent
Dagenais et al.

(10) Patent No.: US 7,000,503 B2
(45) Date of Patent: Feb. 21, 2006

(54) SUPPORT SYSTEM FOR POWER TONG ASSEMBLY

(75) Inventors: Dan Dagenais, Edmonton (CA); Leslie L. Szalacsi, Ononway (CA); Jonathan B. Fraser, St. Albert (CA); Hermann Basler, Stony Plain (CA)

(73) Assignee: McCoy Bros. Inc., Edmonton (CA)

( * ) Notice: Subject to any disclaimer, the term of this patent is extended or adjusted under 35 U.S.C. 154(b) by 78 days.

(21) Appl. No.: 10/832,467

(22) Filed: Apr. 27, 2004

(65) Prior Publication Data

US 2005/0235780 A1 Oct. 27, 2005

(51) Int. Cl.
*B25B 13/50* (2006.01)
*B25B 17/00* (2006.01)
*B25B 29/00* (2006.01)
*B25B 23/04* (2006.01)

(52) U.S. Cl. ..... 81/57.35; 81/57.24; 81/57.17; 81/57.26; 81/57.4; 81/432; 81/434

(58) Field of Classification Search ..... 81/57.35, 81/57.24, 57.17, 57.26, 57.4, 432, 434
See application file for complete search history.

(56) References Cited

U.S. PATENT DOCUMENTS 2,668,689 A * 2/1954 Cormany ..... 81/57.16
3,334,671 A * 8/1967 Agostini et al. ..... 81/57.4
4,082,017 A * 4/1978 Eckel ..... 81/57.16
4,402,239 A * 9/1983 Mooney ..... 81/57.16
4,574,664 A * 3/1986 Curry ..... 81/57.34
4,649,777 A * 3/1987 Buck ..... 81/57.19
4,727,781 A * 3/1988 Yuehui et al. ..... 81/57.34
5,161,438 A * 11/1992 Pietras ..... 81/57.16
6,223,629 B1 * 5/2001 Bangert ..... 81/57.15
6,334,376 B1 * 1/2002 Torres ..... 81/372
2001/0025551 A1 * 10/2001 Pietras ..... 81/57.34
2003/0140736 A1 * 7/2003 Buck ..... 81/57.35

* cited by examiner

*Primary Examiner*—Joseph J. Hail, III
*Assistant Examiner*—Bryan Muller
(74) *Attorney, Agent, or Firm*—David J. French

(57) ABSTRACT

A tong assembly having a powered tong mounted over a backup tong is supported at its rear by a post with torque measuring means. The powered tong is supported at its front, near its throat, by one or more struts that extend downwardly to the backup tong. Such strut (s) provide support for the powered tong when the assembly is placed on a support surface for storage. The struts each have a joint with a retracted condition in which the joint is rigid when the tong is placed on a support surface, and an extended condition in which the joint allows a degree of lateral displacement when the tong assembly is applying torque to a pipe string. This maximizes the amount of torque passing through the rearward post, and therefore ensures a more accurate sensing of applied torque by the torque-measuring device.

10 Claims, 4 Drawing Sheets

SUPPORT SYSTEM FOR POWER TONG ASSEMBLY

FIELD OF THE INVENTION

This invention relates to power tong assemblies used in the oilfield and elsewhere for the purposes of making and breaking joints between pipe sections. It may also have application to other situations where a torque is to be applied to tubular members and especially where it is desired to provide for a predetermined amount of torque to be applied.

BACKGROUND TO THE INVENTION

In using power tongs to make and break joints between sections of a pipe string used in the oil industry, it is customary to provide a tong assembly that includes, generally, an upper powered tong for rotating an upper pipe section of the string, and a lower backup tong which clamps a lower pipe section to resist rotation. Both tongs have jaws which move radially to clamp a pipe section held within a throat portion of the tong, and the powered tong has means, usually hydraulically operated, for rotating its jaws. These two tongs are joined together by suspension means which resist rotation of the lower backup tong relative to the upper tong so that torque can be applied to the pipe joint held between the tongs, and the suspension means allows limited axial movement of the two tongs with respect to each other to accommodate axial movement between the pipe section as the joint is screwed together.

It is desirable that the tong assembly apply a predetermined torque to the joint, to prevent the joint being made too loose or too tight, and for this purpose the torque being applied to the joint may be measured throughout the process of making or breaking joints. This may be accomplished by introducing a torque-measuring device into the suspension means that extends between the upper and lower tongs. In order for this torque-measuring device to operate accurately, substantially all of the torque developed between the two tongs should pass through the measuring device.

It is customary to support the tong assembly by suspending the upper, powered tong from chains or cables connected to a crane hook. Additionally, in the past, short chains have been used as part of the suspension means for the lower tong, these short chains extending between the throat regions of the upper and lower tong. The rear portion of the backup tong, remote from the throat, has in the past been supported by a stiff, but twistable, rear leg or post providing a link between the rear portions of the tongs through which torque developed by the assembly can be measured.

With the use of chains as part of the suspension means between the upper and lower tongs, all of the torque developed by the assembly passes through the twistable rear leg or post (hereinafter the "post") and is measurable by the torque-measuring device. However, a drawback of the use of chain-supports of this type is that when the tong assembly is moved aside from the wellhead for storage, as by being deposited on the ground or other support surface, then, in the absence of a lifting force provided by the crane hook, the upper, powered tong is only supported by the post at the back. This leaves the upper tong supported in a cantilevered manner that may require special reinforcement of the post and post/tong connections or otherwise expose it to damage.

In more recent designs the suspension means for connecting the upper and lower tongs has included legs or struts extending upwardly from the backup tong. These struts replace the short inter-tong chains referenced above. Instead the struts extend from adjacent the backup tong throat, to support the powered tong adjacent its throat. Usually, these struts have been rigidly connected to the upper tong, while lower portions of these struts have passed through apertures in the backup tong and have terminated below the latter tong, the struts supporting the backup tong by means of compression springs extending between the backup tong and the lowest ends of the struts. These springs allow a degree of lateral motion to occur between the struts and the lower tong, and therefore between the upper and lower tongs. As well they allow axial motion to accommodate the relative axial movement between pipe sections as they are joined. Such an arrangement is shown for example in U.S. Pat. No. 6,334,376, which issued Jan. 1, 2002 to Torres. Because the struts extend to below the bottom of the lower tong, when the assembly is set-down on the ground or a deck, the struts provide adequate support for the upper tong in such conditions.

The two tongs will, when applying torque to pipe sections, endeavour to displace themselves laterally with respect to each other in reaction to the torque being applied. This lateral displacement tendency is resisted at the twistable post that carries the torque sensing means. While it is desirable to minimize the amount of this lateral displacement, some displacement must necessarily occur in order for torque to be conveniently measured.

With the suspension means using the struts, e.g. as shown in the aforesaid Torres patent, under high torque conditions a strut passing through an aperture in the backup tong may contact the side of such aperture. When this occurs, a portion of the torque being developed between the upper and lower tongs is absorbed in the strut-to-backup tong contact. This means that the torque measuring device is not measuring the true torque developed between these two units.

A system is required that will provide for the support of the components within a power tong assembly, while minimizing the development of torque transmitted through other means than the torque measuring device.

SUMMARY OF THE INVENTION

In accordance with one aspect of the present invention, in a power tong assembly of of the type having suspension means including struts extending downwardly from an upper, powered tong to a lower, backup tong, the struts either incorporate, or are connected to one of the tongs by, joints that can be selectively rigid or flexible so as to:

1) allow the struts to be effectively rigid when supporting at least part of the vertical load of the powered tong when the tong assembly is placed on a support surface; and
2) allow lower portions of the struts to have a degree of lateral and angular freedom of motion when the power tong assembly is suspended for engaging pipe.

In order to achieve this movement, the struts preferably each incorporate, or end in, a joint which has interacting surfaces which come together to make the joint rigid when the struts are under compression and are retracted, e.g. when the upper tong is being supported by the lower tong; and which surfaces are separated to allow deflection of the struts to occur when the struts are under tension and are extended, e.g. when the backup tong is suspended from the upper tong. In the preferred design the joints automatically become rigid when the tong assembly is in the inoperative condition, i.e. is resting on a support surface, and flexible when the tong is suspended. Alternatively, however, manually operated means such as locking collars may be used to rigidify strut joints for when the tong assembly is inoperative.

With such arrangements, where a measuring device, such as a twistable post, is connected between the tongs and is used to measure torque, any tendency for torque to be diverted from the torque-measuring device is minimized.

In its preferred form, the tong assembly includes:

an upper powered tong having a forward throat portion for receiving, holding and rotating an upper pipe section and having a rearward portion, a lower backup tong having a forward throat portion for receiving and holding a lower pipe section and having a rearward portion, a torque measuring device connecting portions of said tongs, and suspension members connecting the forward portions of the upper and lower tongs, each said suspension member having a rigid, retracted condition and a flexible, extended condition, wherein the suspension members each include strut means incorporating a joint having an upper joint portion and a lower joint portion, and having a lower end portion connected to the lower backup tong, and wherein said upper and lower joint portions have interacting surfaces which hold the upper and lower joint portions rigid with each other when the strut means are in the retracted condition for support of said upper tong, and wherein the interacting surfaces are separated when the strut means are in the extended condition in which the upper tong is supporting the lower tong, the joint allowing limited free movement of the lower backup tong relative to the upper tong when the tongs are being operated.

Preferably, the lower end portion of the strut means extends below the lower tong for contacting a support surface.

Preferably, the upper joint portion is rigidly attached to the upper tong, and the lower joint portion is flexibly connected through the strut means to the lower tong. More preferably, the strut means is flexibly connected to the lower tong through a tong spring to provide support for the lower tong.

The interacting surfaces of the joints may be wedging surfaces. Preferably, these wedging surfaces comprise a conical recess in one of the upper and lower joint portions, and a spigot carried by the other of the joint portions and which engages with the conical recess in the retracted condition of the strut means.

As a further variant the aforesaid spigot may be hollow, and a shaft may extend within the recess and within the hollow spigot and carry a stop member and a strut spring means, which spring means may be a strut compression spring surrounding the shaft and mounted between said stop member and a part of the spigot above the stop member. The strut compression spring then acts to resiliently bias the strut to a retracted condition when the upper tong is placed on a support surface.

According to another aspect of the invention, a suspension member or strut suitable for connecting an upper powered tong to a lower backup tong and having a retracted condition and an extended condition comprises:

an upper strut portion for rigid attachment to said upper tong and having a conical recess forming an upper joint portion, a lower strut portion for flexible connection to the lower tong, said lower strut portion having a spigot at its upper end arranged to form a rigid connection with the recess when fully engaged therein, and spring means tending to urge the spigot into the recess.

The foregoing summarizes the principal features of the invention and some of its optional aspects. The invention may be further understood by the description of the preferred embodiments, in conjunction with the drawings, which now follow.

BRIEF DESCRIPTION OF THE DRAWINGS

The invention will now be described by way of example with reference to the accompanying drawings showing a preferred embodiment of power tong assembly, and in which.

DESCRIPTION OF THE PREFERRED EMBODIMENT

Figure 1:
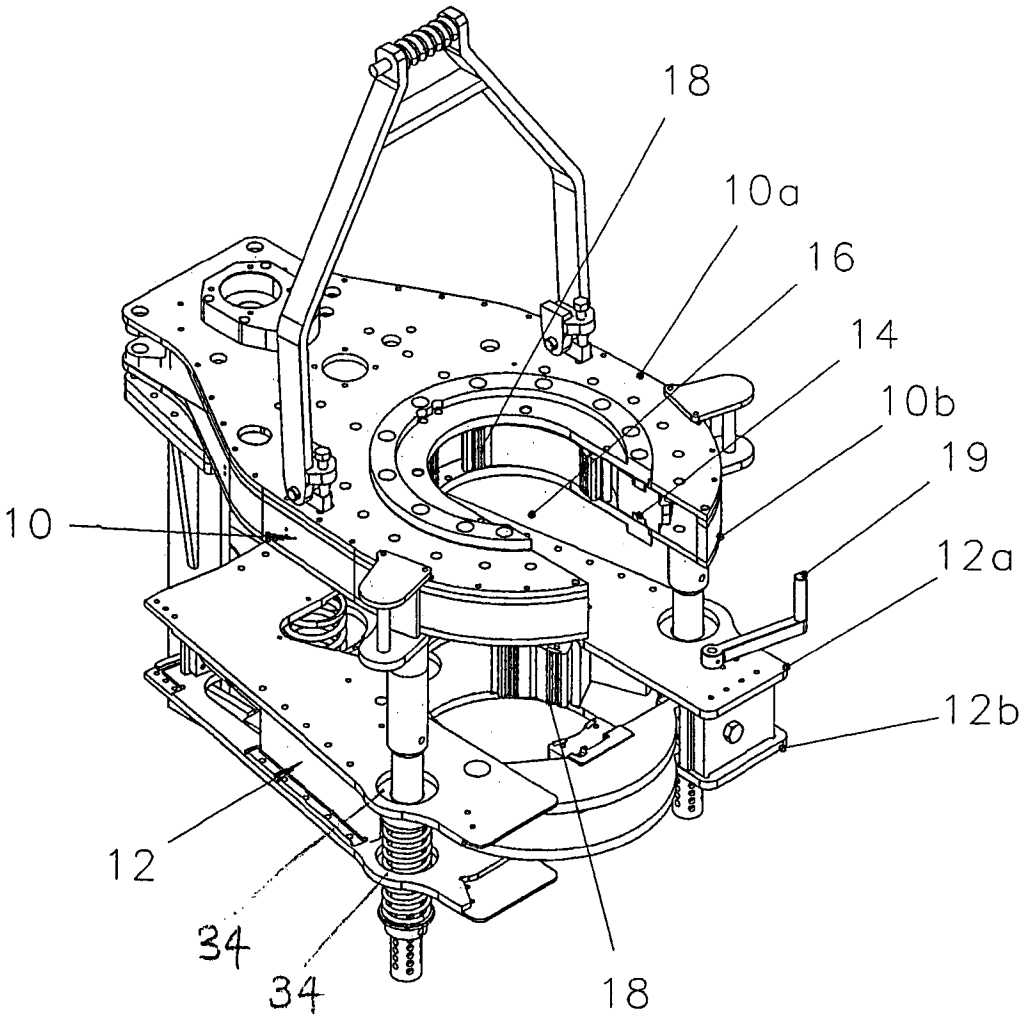
FIG. 1 is a perspective view of the power tong assembly.

Referring to FIGS. 1 to 5, the power tong assembly includes an upper powered tong 10 and a lower, backup tong 12. Each tong has upper and lower cage plates, these being plates 10*a* and 10*b* for the upper tong, and plates 12*a* and 12*b* for the lower tong. The front of each tong has a throat 14 leading to a semi-circular recess 16 for receiving a respective upper and lower pipe section, and each tong has several jaws 18 which are movable radially to grip the pipe sections, operated by cams. The engagement of the jaws on the lower tong are operated by a handle 19. The upper powered tong 10 has, in addition, a hydraulically operated mechanism of a type well-known in the art and which includes a ring gear (not shown) which rotates the jaws to rotate the upper pipe section and thus to effect the coupling and decoupling of pipe joints.

Figure 3:
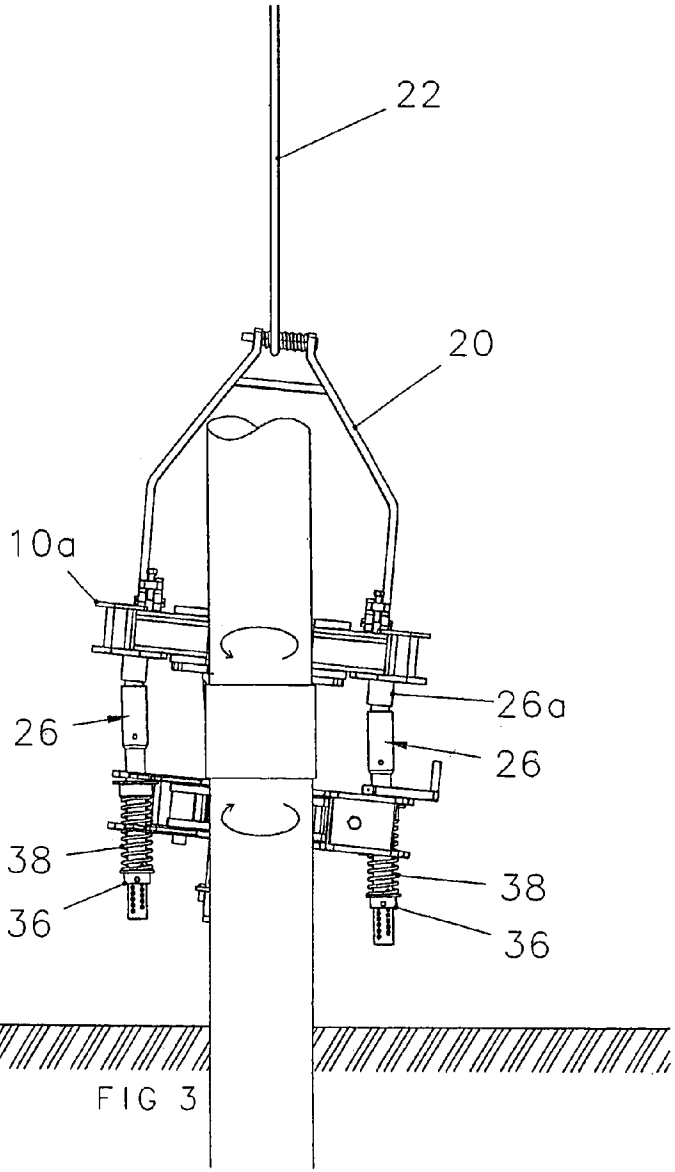
FIG. 3 is a front view of the same assembly in use making the joint.
Figure 2:
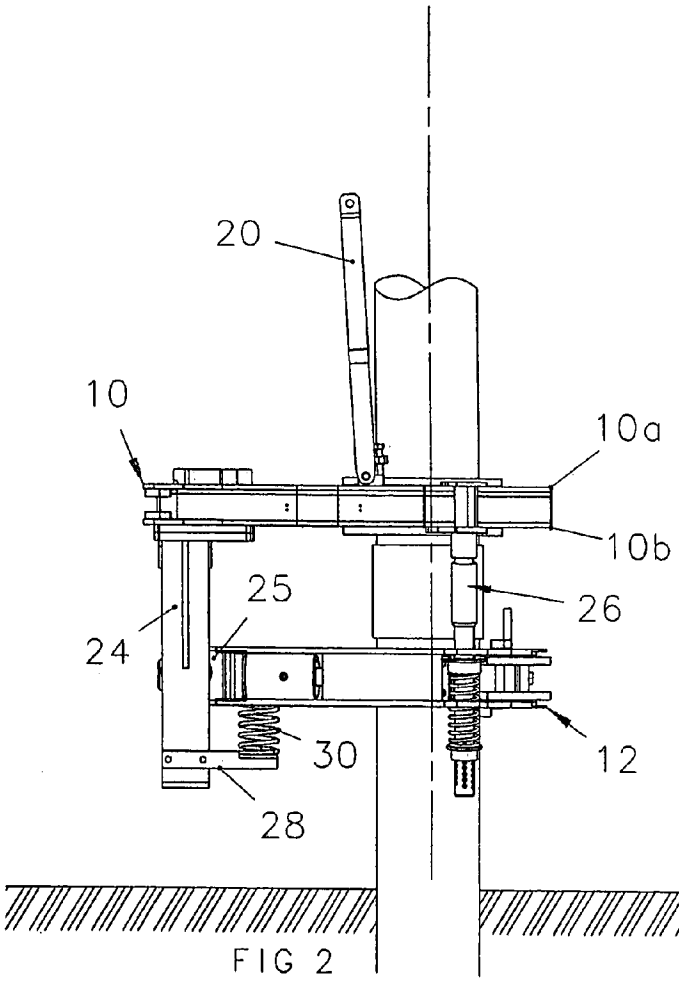
FIG. 2 is a side view of the power tong assembly in use in making a pipe joint.
Figure 5:
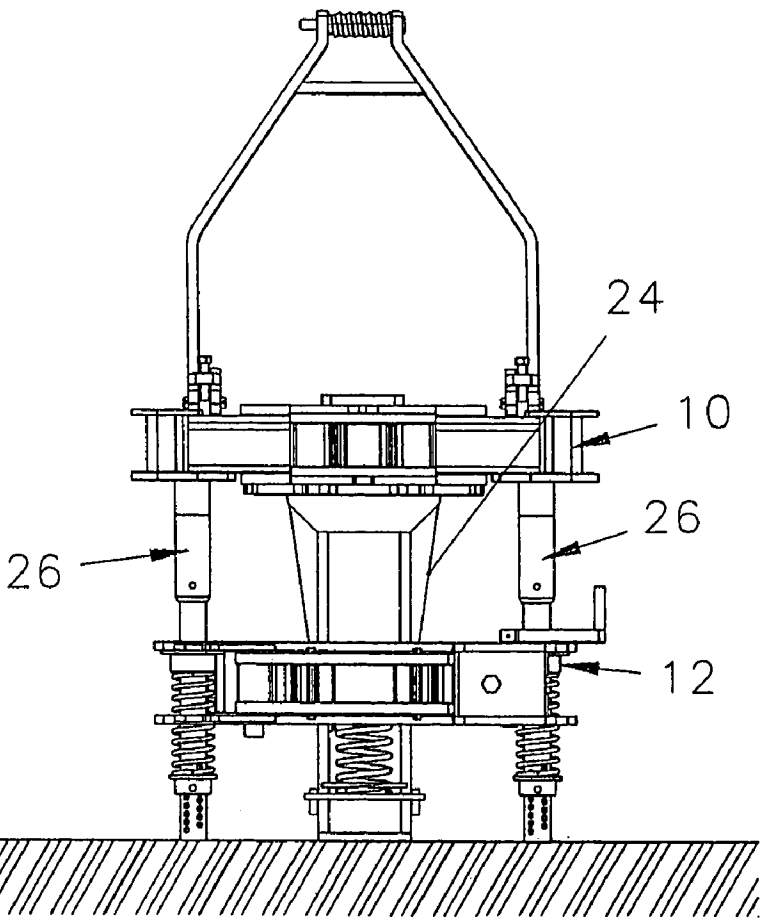
FIG. 5 is a front view of the same assembly resting on a surface.
Figure 4:
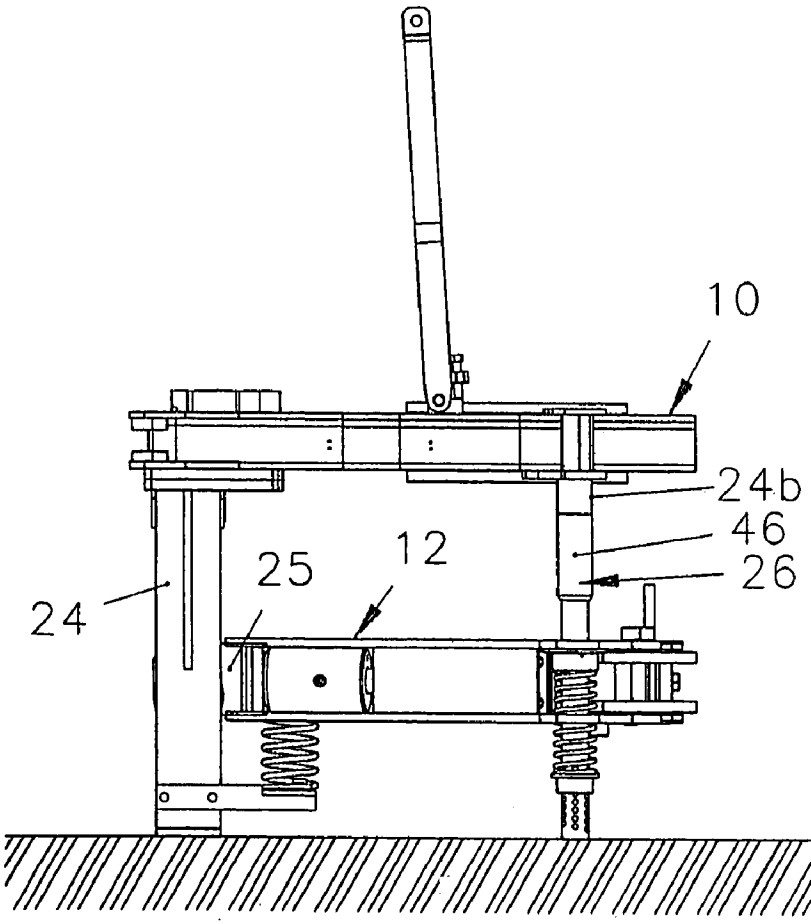
FIG. 4 is a side view of the same assembly when not in use and resting on a surface.

During use, as shown in FIGS. 2 and 3, the upper tong 10 is held suspended by a bracket 20 fixed to upper cage plate 10*a* and suspended from cable 22. The lower tong 12 is in turn suspended from the upper tong by a suspension means including a post 24 connecting rear portions of the tongs, and extendible connecting struts 26 with which this invention is concerned, and which connect outer sides of the throat portions of the tongs.

The post 24 is in the form of a flat-sided channel member which is solidly fixed to the lower plate 10*b* of the upper tong 10. As seen in FIG. 2, the lower end portion this member 24 has a forwards projection 28 supporting a compression spring 30 which in turn supports a rear end portion of the lower tong 12. This lower tong has a rearwards projection 25 in the form of a paddle which is slidable into the forwards facing recess of the post 24, so that torque can be transmitted between the upper and lower tongs, while the tongs are able to move towards and away from each other during making or breaking of a pipe connection. The torque used in making the pipe connection is measured by monitoring the twisting strain in the post 24, e.g. by strain gauges.

Figure 7:
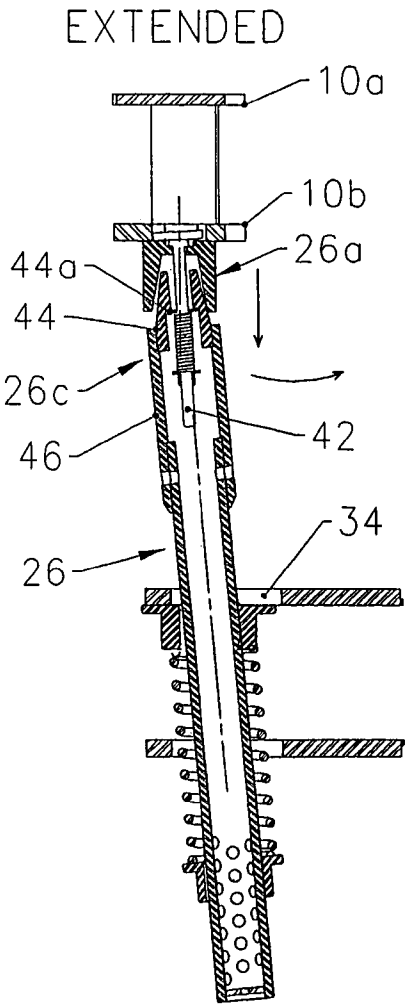
FIG. 7 is a similar view of the same strut when in extended condition.
Figure 6:
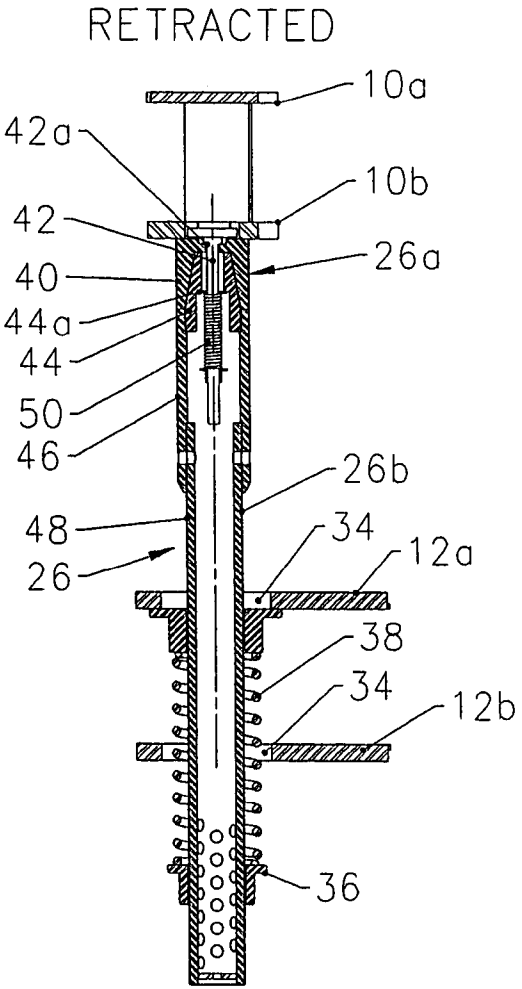
FIG. 6 is a longitudinal section through one of the struts which connect the upper and lower tongs, when in retracted condition.

The extendible struts 26 are shown in detail in FIGS. 6 and 7. As shown, each strut includes an upper joint portion 26*a* which is rigid with the cage plates 10*a* and 10*b* of the upper tong, and a main lower leg 26*b* having at its upper end a lower joint portion 26*c* which cooperates with upper joint portion 26*a*. The lower end portion of leg 26*b* of each strut passes through an aperture 34 in the lower tong cage plates 12*a*, 12*b*, and below the plate 12*b* this end portion is provided with an adjustable stop 36 which supports a compression spring 38 which in turn supports the lower tong 12 through its upper cage plate 12*a*. Thus in use (as in FIGS. 2 and 3) the lower tong 12 is supported at the rear by the spring 30 and in the throat area by the two springs 38 surrounding the two struts. The apertures 34 in the cage plates 12*a*, 12*b* are large enough to allow the legs 26*b* to tilt away from the vertical orientation of FIG. 6 to an orientation of 5 or 10 degrees away from this vertical, as illustrated in FIG. 7; this angle is slightly exaggerated in FIG. 3 to render the effect visible. This pivot movement is permitted by the nature of the joint formed between portions 26*a* and 26*c*, as will now be described.

The upper joint portion 26*a* includes a socket member 40 welded to the lower cage plate 10*b* and having a conical recess with a normally vertical axis. The upper end of socket member 40 has a co-axial aperture in which is loosely mounted a shaft 42 having an enlarged upper end 42*a* which prevents the shaft from being pulled down through this aperture. The lower joint portion includes a hollow conical spigot 44 which can fit closely into the recess in member 40, the lower end of the spigot being cylindrical and being secured within the upper end of a sleeve 46 forming a top portion of the leg 26*b*.

The lower portion of leg 26*b* comprises a tube 48 welded within or bolted to the sleeve 46. The hollow spigot 44 has a downwards facing land 44*a* formed between larger and smaller diameter portions of its hollow interior, and the strut is made resiliently extendible by means of a compression spring 50 trapped between this land and a stop member on a lower end portion of the shaft 42.

FIG. 6 shows the retracted condition of the strut in which the spigot 44 is held closely within the socket 40 to provide a rigid joint, while FIG. 7 shows the extended condition in which the spigot is separated from the recess, with the associated compression of spring 50, thus permitting some angular movement of the leg 26*b*. The FIG. 6 retracted condition is that which applies when the tong assembly is inoperative and is resting on the ground or other supporting surface, as in FIGS. 4 and 5, and where adequate support is provided for the front of the upper tong without placing undue bending stress on the post 24.

FIG. 7 shows the operative condition, also shown in FIGS. 2 and 3, where the strut 26 is extended by lifting the upper tong 10 with bracket 20 and so causing the struts 26 to be in tension to support the backup tong 12. In this condition pivotal movement of the leg 26*b* ensures that this leg does not interfere with sideways movement of the backup tong 12, so that accurate measurement of torsion can be obtained by monitoring the torsion on the post 24.

CONCLUSION

The foregoing has constituted a description of specific embodiments showing how the invention may be applied and put into use. These embodiments are only exemplary. The invention in its broadest, and more specific aspects, is further described and defined in the claims which now follow.

We claim:

1. A power tong assembly of the type having a suspension including struts extending downwardly from an upper, powered tong to a lower, backup tong, wherein the struts comprise joints either located within the strut or that operatively connect the strut to one of the tongs, said struts being configured to be selectively rigid or flexible so as to:

1) allow the struts to be effectively rigid when supporting at least part of the vertical load of the powered tong when the tong assembly is placed on a support surface; and 2) allow lower portions of the struts to have a degree of lateral and angular freedom of motion when the power tong assembly is suspended for engaging pipe.

2. A power tong assembly according to claim 1, wherein the struts each incorporate, or end in, a joint which has interacting surfaces which come together to make the joint rigid when the struts are under compression and are retracted, as when the upper tong is being supported by said struts, said surfaces becoming separated to allow deflection of the struts to occur when the struts are under tension and are extended, as when the backup tong is suspended from the upper tong.

3. A power tong assembly comprising:

an upper powered tong having a forward throat portion for receiving, holding and rotating an upper pipe section and having a rearward portion, a lower backup tong having a forward throat portion for receiving and holding a lower pipe section and a rearward portion, a torque measuring device connecting portions of said tongs, and extendible suspension members connecting the forward portions of the upper and lower tongs, each said suspension members having a retracted condition and an extended condition, wherein said suspension members each include a strut incorporating a joint having an upper joint portion and a lower joint portion, said strut having a lower portion connected to support the lower backup tong, and wherein said upper and lower joint portions have interacting surfaces which hold said upper and lower joint portions rigid with each other when the strut is supporting the upper tong and when the suspension members are in the retracted condition, and wherein said interacting surfaces are separated when the upper tong is supporting, by suspension, the lower tong and when the suspension members are in the extended condition, in which extended condition the strut allow limited free movement of the lower backup tong relative to the upper tong.

4. A power tong assembly according to claim 3, wherein said upper joint portion is rigidly attached to the upper tong, and wherein the lower joint portion is flexibly connected through said strut to said lower tong by resilient springs.

5. A power tong assembly according to claim 3, wherein said suspension members include spring means urging the upper and lower joint portions into the retracted condition.

6. A power tong assembly according to claim 3, wherein said interacting surfaces are wedging surfaces.

7. A power tong assembly according to claim 6, wherein said wedging surfaces comprise a conical recess in one of said upper and lower joint portions, and a spigot carried by the other of said joint portions and which engages within the recess in the retracted condition of the suspension members.

8. A power tong assembly according to claim 6, wherein said wedging surfaces comprise a conical recess in said upper joint portion and a spigot forming the said lower joint portion and which spigot engages with the recess in the retracted condition of the suspension means, and further comprising spring means acting between said upper and lower joint portions tending to advance the spigot into the recess.

9. A power tong assembly according to claim 8, wherein said spigot is hollow, and wherein a shaft extends within said recess and within said hollow spigot and carries a stop member, and wherein said spring means is a compression spring surrounding said shaft and mounted between said stop member and a part of said spigot above said stop member.

10. A power tong assembly as in claim 1 wherein said upper and lower tongs are mounted on a common support post and further comprising torque measurement means coupled to said post for measuring torque developed in said post between said upper and lower tongs.

* * * * *